US012622564B2

(12) United States Patent
Blanchard et al.

(10) Patent No.: US 12,622,564 B2
(45) Date of Patent: May 12, 2026

(54) SYSTEM AND METHOD FOR CENTRALIZED STEAM CLEANING

(71) Applicant: Clean Core LLC, Hillsboro, OR (US)

(72) Inventors: Sean Blanchard, Hillsboro, OR (US); Daniel Blexrude, Portland, OR (US)

(73) Assignee: Clean Core LLC, Hillsboro, OR (US)

( * ) Notice: Subject to any disclaimer, the term of this patent is extended or adjusted under 35 U.S.C. 154(b) by 105 days.

(21) Appl. No.: 18/521,165

(22) Filed: Nov. 28, 2023

(65) Prior Publication Data

US 2024/0180388 A1 Jun. 6, 2024

Related U.S. Application Data

(60) Provisional application No. 63/429,900, filed on Dec. 2, 2022.

(51) Int. Cl.

| | |
|---|---|
| ***A47L 11/40*** | (2006.01) |
| ***A47L 5/38*** | (2006.01) |
| ***A47L 11/34*** | (2006.01) |

(52) U.S. Cl.
CPC ..... *A47L 11/4088* (2013.01); *A47L 5/38* (2013.01); *A47L 11/34* (2013.01); *A47L 11/4086* (2013.01)

(58) Field of Classification Search
None
See application file for complete search history.

(56) References Cited

U.S. PATENT DOCUMENTS

2004/0088815 A1* 5/2004 Tracy ..... A47L 5/38 15/314
2015/0345681 A1* 12/2015 Sodo ..... F16L 37/48 285/351

* cited by examiner

*Primary Examiner* — Kaj K Olsen
*Assistant Examiner* — Pradhuman Parihar
(74) *Attorney, Agent, or Firm* — Klarquist Sparkman, LLP

(57) ABSTRACT

Certain examples of the disclosure concern a centralized steam cleaning system which includes a central control unit and a pipe network distributed within a building. The pipe network can include a vacuum pipeline and a water pipeline extending alongside each other.

20 Claims, 8 Drawing Sheets

SYSTEM AND METHOD FOR CENTRALIZED STEAM CLEANING

CROSS-REFERENCE TO RELATED APPLICATION

This application claims the benefit of U.S. Provisional Application No. 63/429,900, filed Dec. 2, 2022, which is incorporated by reference herein.

FIELD

The present disclosure concerns systems and methods related to centralized steam cleaning for buildings.

BACKGROUND

Steam cleaning involves using steam or vapor for cleaning, and can be used for cleaning carpet, tile and grout, upholstery, etc. However, steam cleaning can be laborious and time consuming, especially for high rise buildings that include numerous rooms on multiple floors. Using a portable steam cleaner to clean multiple rooms is generally inefficient. Using an industrial steam cleaning machine (e.g., a truck mount carpet cleaning machine) with extendable hoses to clean a building is also limited by many factors, such as the height of the building, the floor plan of individual rooms, etc. The complexity and length of operation also lead to increased costs. Thus, there exists a need for improved steam cleaning techniques for buildings.

SUMMARY

Described herein are apparatuses, systems, and methods for centralized steam cleaning for buildings, which overcome one or more of the deficiencies of state-of-the-art steam cleaning technologies.

In some aspects, the techniques described herein relate to a centralized steam cleaning system including: a central control unit; and a pipe network connected to the central control unit, wherein the pipe network is configured to be distributed within a building, wherein the pipe network includes a vacuum pipeline and a water pipeline that extend alongside each other, wherein the central control unit is configured to generate a negative pressure for air within the vacuum pipeline and a water steam within the water pipeline.

In some aspects, the techniques described herein relate to a centralized steam cleaning system, wherein the negative pressure is between 6 psi and 9 psi, wherein the water steam has a temperature ranging between 200- and 240-degree Fahrenheit.

In some aspects, the techniques described herein relate to a centralized steam cleaning system, further including a plurality of ports connected to the pipe network, wherein each port includes an outlet of the water pipeline and an outlet of the vacuum pipeline.

In some aspects, the techniques described herein relate to a centralized steam cleaning system, wherein the plurality of ports includes one or more floor ports configured to be located at corresponding floors of the building, wherein each floor port includes a housing enclosing the outlet of the water pipeline and the outlet of the vacuum pipeline, wherein the water pipeline and the vacuum pipeline extend from a first side of the housing to a second side of the housing.

In some aspects, the techniques described herein relate to a centralized steam cleaning system, wherein each floor port includes an air valve and a water valve enclosed within the housing, wherein the air valve is configured to enable or disable the air within the vacuum pipeline to flow from the first side of the housing to the second side of the housing, wherein the water valve is configured to enable or disable the water steam within the water pipeline to flow from the first side of the housing to the second side of the housing.

In some aspects, the techniques described herein relate to a centralized steam cleaning system, wherein the plurality of ports includes one or more room ports configured to be located within corresponding rooms of the building, wherein each room port includes a housing enclosing the outlet of the water pipeline and the outlet of the vacuum pipeline, wherein the water pipeline and the vacuum pipeline extend into the housing and do not exit from the housing.

In some aspects, the techniques described herein relate to a centralized steam cleaning system, wherein each room port includes a water valve enclosed within the housing, wherein the water valve is configured to enable or disable the water steam within the water pipeline to flow through the outlet of the water pipeline.

In some aspects, the techniques described herein relate to a centralized steam cleaning system, further including a hose assembly, wherein the hose assembly includes a water hose and a vacuum hose, wherein the water hose is configured to be releasably connected to the outlet of the water pipeline, wherein the vacuum hose is configured to be releasably connected to the outlet of the vacuum pipeline.

In some aspects, the techniques described herein relate to a centralized steam cleaning system, wherein the outlet of the water pipeline includes a seal configured to block the water steam within the water pipeline from escaping through the outlet of the water pipeline, wherein connecting the water hose to the outlet of the water pipeline is configured to displace the seal so as to enable the water steam within the water pipeline to escape through the outlet of the water pipeline.

In some aspects, the techniques described herein relate to a centralized steam cleaning system, further including at least one portable cleaning device, wherein the portable cleaning device includes a water channel and a vacuum channel, wherein the water channel is configured to be releasably connected to the water hose, wherein the vacuum channel is configured to be releasably connected to the vacuum hose.

In some aspects, the techniques described herein relate to a centralized steam cleaning system including: a pipe network configured to be distributed within a building, wherein the pipe network includes a vacuum pipeline and a water pipeline that extend alongside each other; and a plurality of ports connected to the pipe network, wherein each port includes an outlet of the water pipeline and an outlet of the vacuum pipeline, wherein the water pipeline is configured to allow a water steam to flow therethrough, wherein the vacuum pipeline is configured to allow an air under negative pressure to flow therethrough.

In some aspects, the techniques described herein relate to a centralized steam cleaning system, further including a central control unit configured to generate the negative pressure for the air within the vacuum pipeline and the water steam within the water pipeline.

In some aspects, the techniques described herein relate to a centralized steam cleaning system, further including a hose assembly, wherein the hose assembly includes a water hose and a vacuum hose that are bundled together, wherein the water hose is configured to be releasably connected to the outlet of the water pipeline, wherein the vacuum hose is configured to be releasably connected to the outlet of the vacuum pipeline.

In some aspects, the techniques described herein relate to a centralized steam cleaning system, further including at least one portable cleaning device, wherein the portable cleaning device includes a wand, a cleaning head connected to a distal end of the wand, a water channel, and a vacuum channel, wherein the water channel and the vacuum channel extend through a lumen of the wand and into the cleaning head, wherein the water channel is configured to be releasably connected to the water hose, wherein the vacuum channel is configured to be releasably connected to the vacuum hose.

In some aspects, the techniques described herein relate to a centralized steam cleaning system, wherein the plurality of ports includes one or more floor ports, wherein each floor port includes a floor port casing enclosing the outlet of the water pipeline and the outlet of the vacuum pipeline, wherein the water pipeline and the vacuum pipeline extend through the floor port casing.

In some aspects, the techniques described herein relate to a centralized steam cleaning system, wherein the plurality of ports includes one or more room ports, wherein each room port includes a room port casing enclosing the outlet of the water pipeline and the outlet of the vacuum pipeline, wherein the water pipeline and the vacuum pipeline extend into the room port casing and do not exit from the room port casing.

In some aspects, the techniques described herein relate to a method for steam cleaning a building, the method including: generating a negative air pressure within a vacuum pipeline; generating a water steam within a water pipeline; releasing the water steam from the water pipeline to a selected area within the building; and vacuuming the selected area by applying the negative air pressure within the vacuum pipeline, wherein the water pipeline and the vacuum pipeline extend alongside each other and form a pipe network distributed within the building.

In some aspects, the techniques described herein relate to a method, further including opening a housing enclosing an outlet of the water pipeline and an outlet of the vacuum pipeline, wherein releasing the water steam includes connecting a water hose to the outlet of the water pipeline, wherein the vacuuming includes connecting a vacuum hose to the outlet of the vacuum pipeline.

In some aspects, the techniques described herein relate to a method, wherein releasing the water steam further includes connecting a water channel to the water hose, wherein the vacuuming further includes connecting a vacuum channel to the vacuum hose, wherein the water channel and the vacuum channel extend through a wand a portable cleaning device.

In some aspects, the techniques described herein relate to a method, further including disabling flow of the water steam within at least a portion of the water pipeline so as to reduce water pressure at the outlet of the water pipeline before connecting the water hose to the outlet of the water pipeline.

The foregoing and other features and advantages of the disclosed technologies will become more apparent from the following detailed description, which proceeds with reference to the accompanying figures.

DETAILED DESCRIPTION

General Considerations

Figure 1:
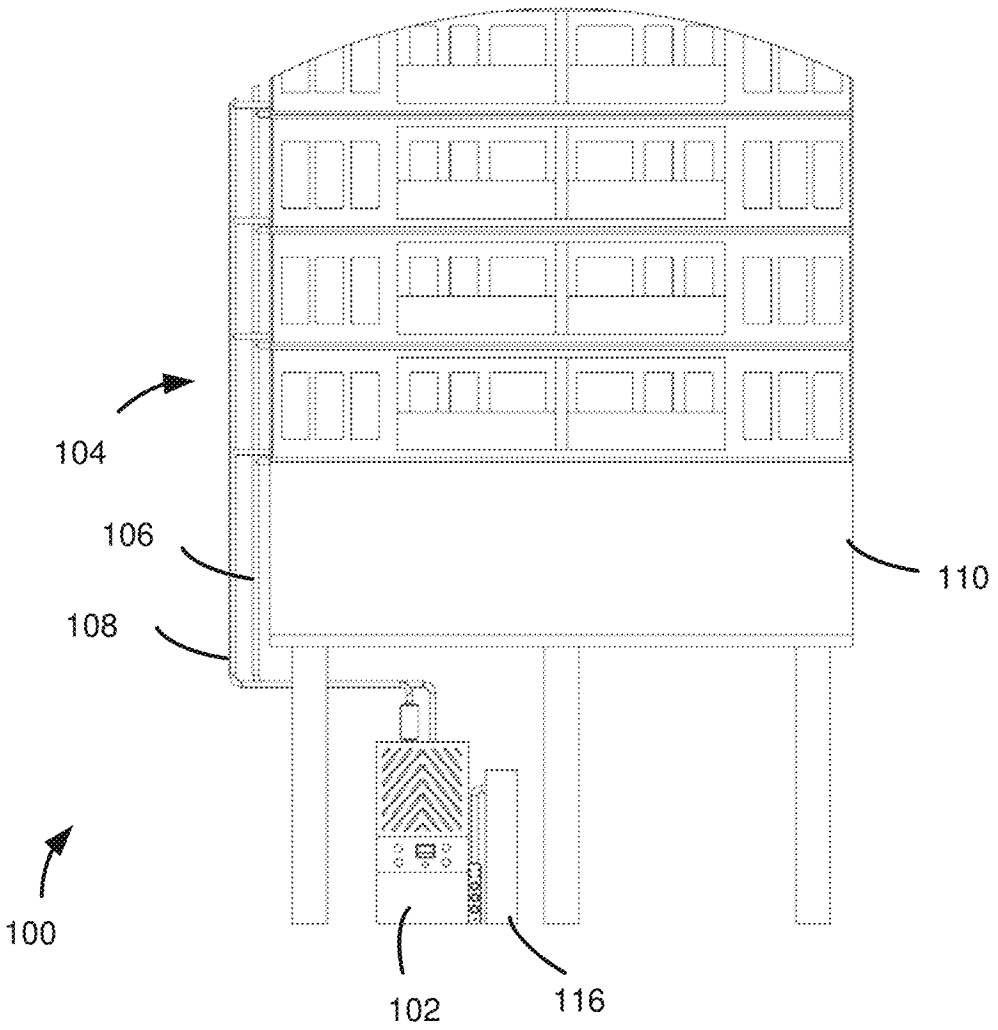
FIG. 1 schematically depicts an example centralized steam cleaning system that can be used in a building.

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed examples, alone and in various combinations and sub-combinations with one another. The methods, apparatus, and systems are not limited to any specific aspect or feature or combination thereof, nor do the disclosed examples require that any one or more specific advantages be present or problems be solved. The technologies from any example can be combined with the technologies described in any one or more of the other examples. In view of the many possible examples to which the principles of the disclosed technology may be applied, it should be recognized that the illustrated examples are only preferred examples and should not be taken as limiting the scope of the disclosed technology.

Although the operations of some of the disclosed examples are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art. Any theories of operation are to facilitate explanation, but the disclosed systems, methods, and apparatus are not limited to such theories of operation.

As used in this application and in the claims, the singular forms "a," "an," and "the" include the plural forms unless the context clearly dictates otherwise. Additionally, the term "includes" means "comprises." Further, the terms "coupled" and "connected" generally mean electrically, electromagnetically, and/or physically (e.g., mechanically or chemically) coupled or linked and does not exclude the presence of intermediate elements between the coupled or associated items absent specific contrary language.

Directions and other relative references (e.g., inner, outer, upper, lower, etc.) may be used to facilitate discussion of the drawings and principles herein, but are not intended to be limiting. For example, certain terms may be used such as "inside," "outside," "interior," "exterior," and the like. Such terms are used, where applicable, to provide some clarity of description when dealing with relative relationships, particularly with respect to the illustrated examples. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

Example Central Steam Cleaning System

FIG. 1 depicts an example central steam cleaning system 100 that can be used in a building 110. In the depicted example, the building 110 has multiple floors. In other examples, the building 110 can have only a single floor.

The central steam cleaning system 100 includes a central control unit 102 which is fluidly connected to a water reserve 116. The central steam cleaning system 100 also includes a pipe network 104 distributed within the building 110 (e.g., through dry walls, floors, and/or other constructs of the building). The pipe network 104 can extend to areas of the building 110 (e.g., hallways, rooms, etc.) that need cleaning. As shown, the pipe network 104 includes a water pipeline 106 and a vacuum pipeline 108 that run in parallel to each other. As described herein, two pipelines (or channels) are deemed to run in parallel if they are arranged side by side (i.e., extend alongside each other), running in the same direction without intersecting each other and maintaining a consistent separation throughout their length. In the depicted example, the central control unit 102 is located at the lowest level of the building 110. In other examples, the central control unit 102 can be located in the basement or higher-level floors of the building.

In some instances, the building 110 (e.g., when the building 110 is a skyscraper having many floors) can be installed with multiple central steam cleaning systems 100, each having its own central control unit 102 and corresponding pipe network 104. The central steam cleaning systems 100 can work independently, each being used for cleaning of designated areas (e.g., multiple floors) of the buildings.

The central control unit 102 can be configured to generate a negative pressure within the vacuum pipeline 108. As described herein, a negative pressure means a pressure that is below the atmospheric (or ambient) pressure. The central control unit 102 can also be configured to generate a hot water steam within the water pipeline 106. Details of examples of the central control unit 102 are described more fully below.

In some examples, the generated negative pressure can be in the range of 0-14 psi, or 6 psi-9 psi. In one specific example, the generated negative pressure can be about 10%-50% about the atmospheric pressure.

In some examples, the generated temperature of the water steam can be in the range of 175-250 degrees Fahrenheit, or 200-240 degrees Fahrenheit. In one specific example, the temperature of the water steam can be about 230 degrees Fahrenheit.

Figure 2:
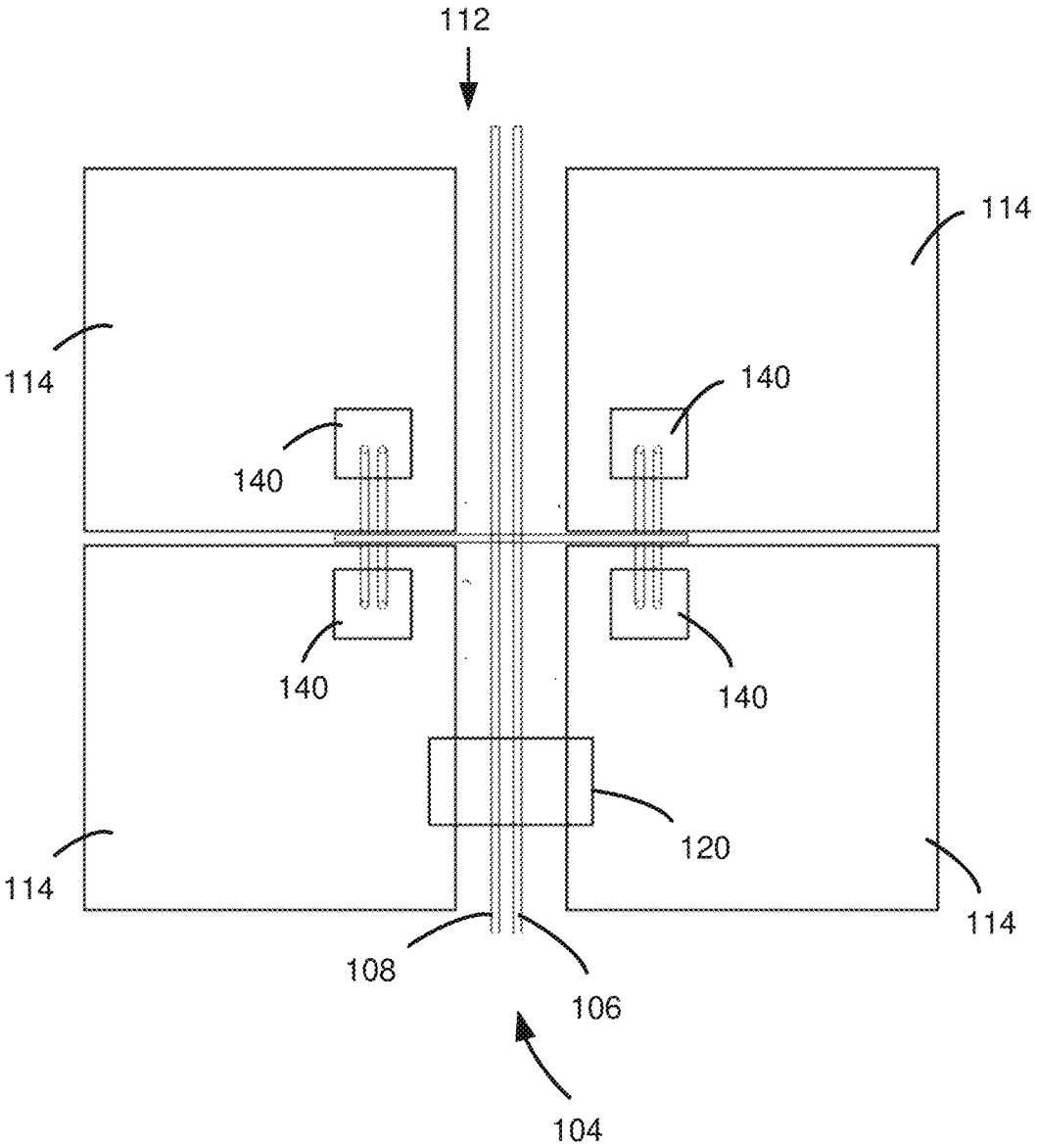
FIG. 2 schematically depicts the distribution of pipe network of the centralized steam cleaning system of FIG. 1 on a floor of a building.

FIG. 2 shows branching of the pipe network 104 on one floor of the building 110, according to one example. As shown, the floor can have multiple rooms 114 and one or more hallways 112 (or aisles) extending between some of the rooms. The pipe network 104, which includes the vacuum pipeline 108 and the water pipeline 106, can extend along the hallways 112 and into the rooms 114. Both the vacuum pipeline 108 and the water pipeline 106 can form branches, e.g., by using connectors. For example, a tee connector can be used to split one pipe into two, directing air and/or water steam flow to multiple locations; an elbow connector enables pipes to make 90-degree turns and facilitates changes in direction; a Y-shaped fitting can create a branch by diverting air and/or water steam from a single source into two separate directions. In some examples, only areas of the building that requires steam cleaning services are supplied with the vacuum pipeline 108 and the water pipeline 106. In some examples, the routes for installing the pipe network 104 can be optimized to reduce the overall length of the pipes. In any of the examples described herein, the pipes of the pipe network 104 (including the vacuum pipeline 108 and the water pipeline 106) can be concealed from users (e.g., behind a drywall, under the floor, above the ceiling, etc.).

In some examples, the central steam cleaning system 100 can include a plurality of ports connected to the pipe network 104. Each port can include an outlet of the water pipeline 106 and an outlet of the vacuum pipeline 108. For example, FIG. 2 shows a floor port 120 and four room ports 140. Each room port 140 can be located in one of the rooms 114 that needs cleaning services. In some examples, each floor port 120 can be located in a corresponding floor of the building that needs cleaning services. As described below, each floor port can have an air valve and a water valve configured to turn on or off the air flow and/or water steam flow within the vacuum pipeline 108 and water pipeline 106 at corresponding floors of the building, respectively.

Figure 3:
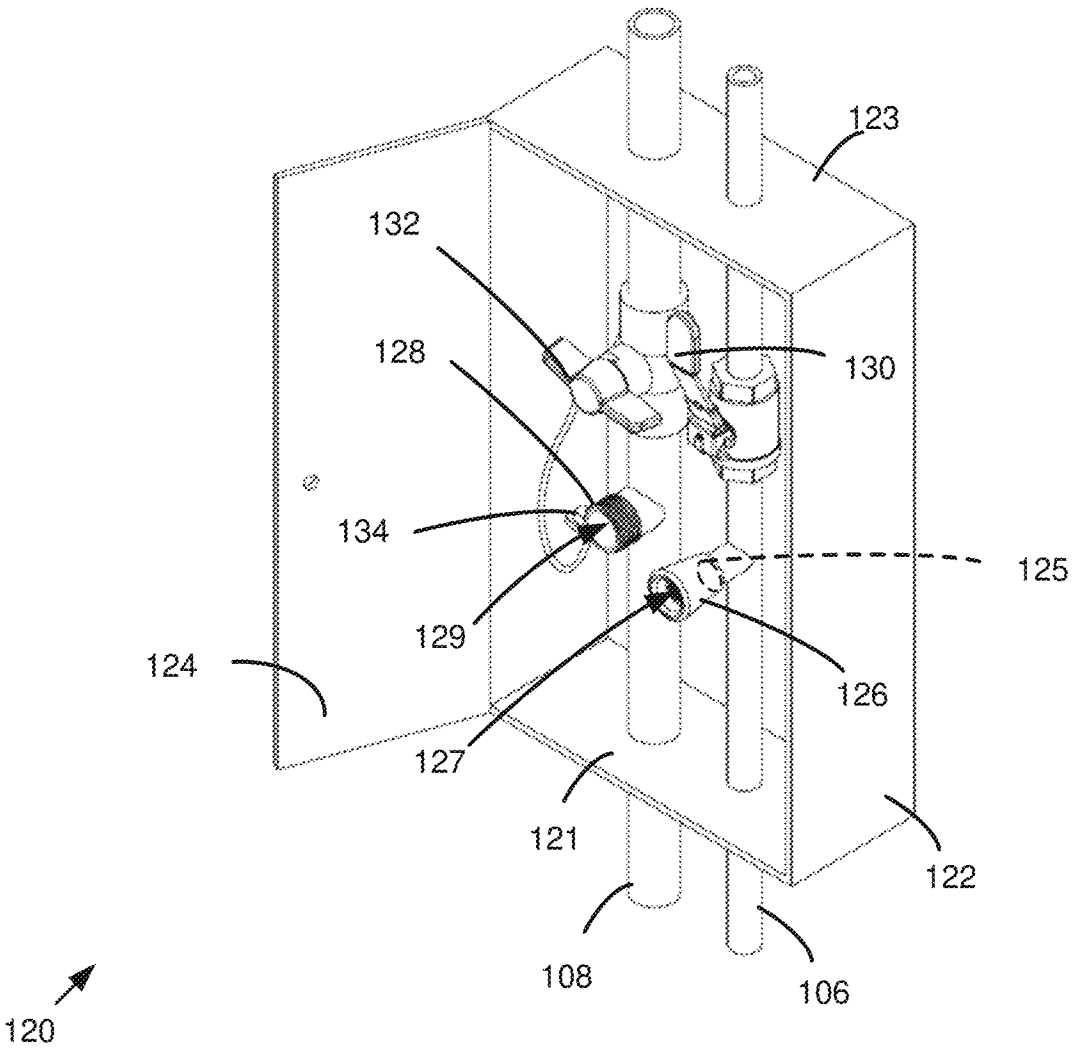
FIG. 3 is a perspective view of a floor port of the centralized steam cleaning system of FIG. 1, according to one example.

FIG. 3 shows an example floor port 120, which can be mounted on a side wall of a hallway or other locations on a floor of the building. The floor port 120 can include a housing 122 (e.g., a cabinet, or the like). The housing 122 can have a cover or door 124, which can be locked or unlocked by an operator of the central steam cleaning system 100. The housing 122 can also be referred to as a "floor port casing."

The pipe network 104 can extend through the housing 122. For example, the vacuum pipeline 108 and water pipeline 106 can enter the housing 122 from one side 121 of the housing 122 and exit the housing 122 from an opposite side 123 of the housing 122.

The floor port 120 can have a water valve 130 connected to the water pipeline 106 and an air valve 132 connected to the vacuum pipeline 108. The operator can turn ON or OFF the air valve 132 and/or the water valve 130. The water valve 130 and the air valve 132 are located within the housing 122.

When the water valve 130 is turned to an ON position, water steam is allowed to pass through the portion of the water pipeline 106 between the side 121 and side 123. When the water valve 130 is turned to an OFF position, water steam is blocked from passing through the portion of the water pipeline 106 between the side 121 and side 123.

Similarly, when the air valve 132 is turned to an ON position, air is allowed to flow through the portion of the vacuum pipeline 108 between the side 121 and side 123. When the air valve 132 is turned to an OFF position, air is blocked from flowing through the portion of the vacuum pipeline 108 between the side 121 and side 123.

In certain examples, the operator can turn off both the air valves 132 and water valves 130 in the floor ports 120 of selected floors. That will shut off both air flow and water steam flow in the pipe network 104 for those selected floors. Such selected shut-off can be used to increase the negative pressure and water pressure in other floors (e.g., by pausing air flow and water steam flow in the selected floors).

As shown in FIG. 3, the floor port 120 can have a water adaptor 126 connected to the water pipeline 106 and an air adaptor 128 connected to the vacuum pipeline 108. The water adaptor 126 defines an outlet of the water pipeline 106 and the air adaptor 128 defines an outlet of the vacuum pipeline 108 at the floor port 120. Both the water adaptor 126 and the air adaptor 128 can be located within the housing 122. The water adaptor 126 and the air adaptor 128 can be connected to certain accessories of the central steam cleaning system 100, such as a hose assembly 200 (including a water hose 206 and a vacuum hose 208) depicted in FIG. 7A and described further below.

The water adaptor 126 has a lumen 127 which can fluidly communicate with the portion of the water pipeline 106 located between the side 121 and side 123. In some examples, the water adaptor 126 can have an inner seal 125 configured to block the water or water steam in the water pipeline 106 from flowing out of the water adaptor 126 through the lumen 127. As described below, when connected to the water hose 206, the seal 125 can be displaced so as to allow the water or water steam in the water pipeline 106 to flow into the water hose 206 through the lumen 127 of the water adaptor 126.

In certain examples, before connecting the water hose 206 to the water adaptor 126, the water valve 130 is first turned to the OFF position to shut off water steam flow through the portion of the water pipeline 106 located between the side 121 and side 123. This can reduce the water pressure at the water adaptor 126 so that it has less resistance and makes it easier for the operator to connect the water hose 206 to the water adaptor 126.

The air adaptor 128 has a lumen 129 which can fluidly communicate with the portion of the vacuum pipeline 108 located between the side 121 and side 123. In some examples, the air adaptor 128 can have a cap 134. When not in use, the lumen 129 of the air adaptor 128 can be covered by the cap 134. The cap 134 can be removed for connecting to the vacuum hose 208, as described further below.

Figure 4B:
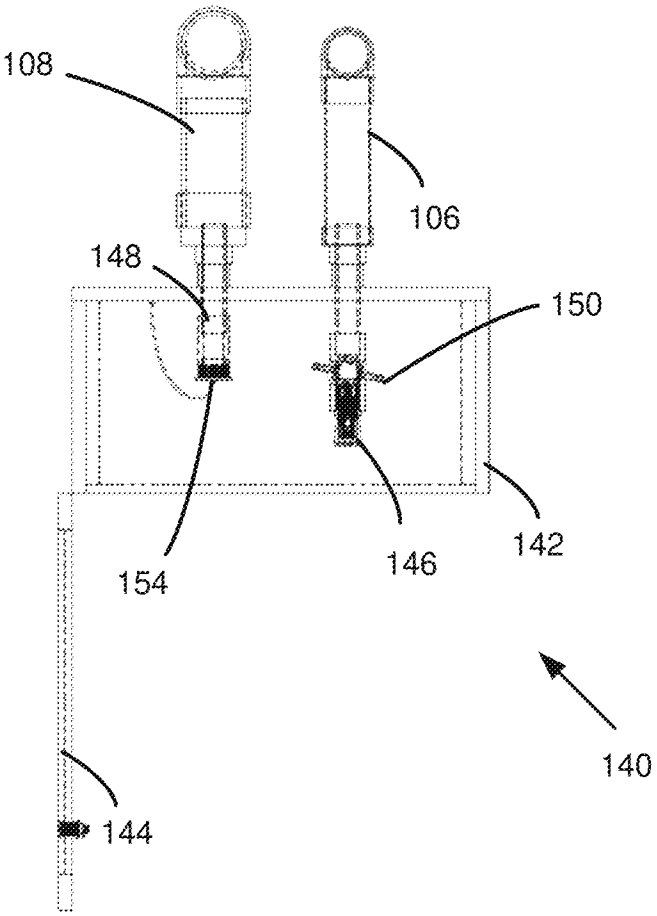
FIG. 4B is a top view of the room port of FIG. 4A.
Figure 4A:
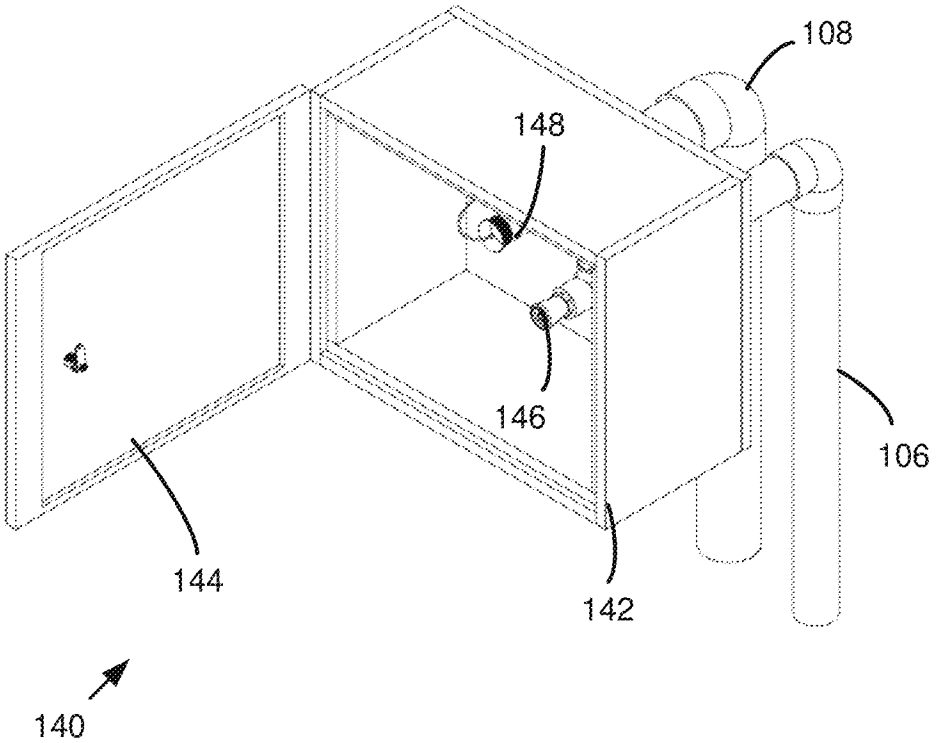
FIG. 4A is a perspective view of a room port of the centralized steam cleaning system of FIG. 1, according to one example.

FIGS. 4A-4B depict an example room port 140, which can be mounted on a side wall or other locations within a room. Similar to the floor port 120, the room port 140 can include a housing 142 (e.g., a cabinet, or the like). The housing 142 can have a cover or door 144, which can be locked or unlocked by the operator of the central steam cleaning system 100. The housing 142 can also be referred to as a "room port casing."

The pipe network 104 can have a terminal interface with the housing 142. For example, the vacuum pipeline 108 and water pipeline 106 can enter the housing 142 from a back side of the housing 142. Unlike the floor port 120 wherein the vacuum pipeline 108 and water pipeline 106 enter from one side of the housing 121 and exit from another side 123 of the housing 122, each room port 140 represents a terminal end for a branch of the pipe network 104 because the vacuum pipeline 108 and water pipeline 106 do not exit from the housing 142.

As shown, the room port 140 can have a water adaptor 146 (similar to 126) connected to the water pipeline 106 and an air adaptor 148 (similar to 128) connected to the vacuum pipeline 108. The water adaptor 146 defines an outlet of the water pipeline 106 and the air adaptor 128 defines an outlet of the vacuum pipeline 108 at the room port 140. Both the water adaptor 146 and the air adaptor 148 are located within the housing 142. Likewise, the water adaptor 126 and the air adaptor 128 can be connected to certain accessories of the central steam cleaning system 100, such as a hose assembly 200 depicted in FIG. 7A and described further below.

Similar to 126, the water adaptor 146 has a lumen which can fluidly communicate with the water pipeline 106. The water adaptor 146 can also have an inner seal (similar to 125) configured to block the water or water steam in the water pipeline 106 from flowing into the lumen off the water adaptor 146. When connected to the water hose 206, such seal can be displaced so as to allow the water or water steam in the water pipeline 106 to flow into the water hose 206 through the lumen of the water adaptor 146.

Additionally, the water adaptor 146 can have a water valve 150 which can be turned ON or OFF. The water valve 150 can be located within the housing 142. Turning the water valve 150 to the ON position allows the water or water steam to flow through the lumen of the water adaptor 146, while turning the water valve 150 to the OFF position blocks the lumen within the water adaptor 146. In some examples, the water valve 150 can be positioned distal to the inner seal (i.e., farther away from the opening of the water adaptor 146). Thus, even if the inner seal of the water adaptor 146 is displaced (e.g., by connecting the water hose 206 to the water adaptor 146), the water valve 150 can still prevent water or water steam in the water pipeline 106 from entering the lumen of the water adaptor 146.

In certain examples, before connecting the water hose 206 to the water adaptor 146, the water valve 150 is first turned to the OFF position. This can reduce the water pressure at the water adaptor 146 so that it has less resistance and makes it easier for the operator to connect the water hose 206 to the water adaptor 146.

Similar to 128, the air adaptor 148 has a lumen which can fluidly communicate with the vacuum pipeline 108. A cap 154 can be used to cover or expose the lumen of the air adaptor 148.

Figure 5:
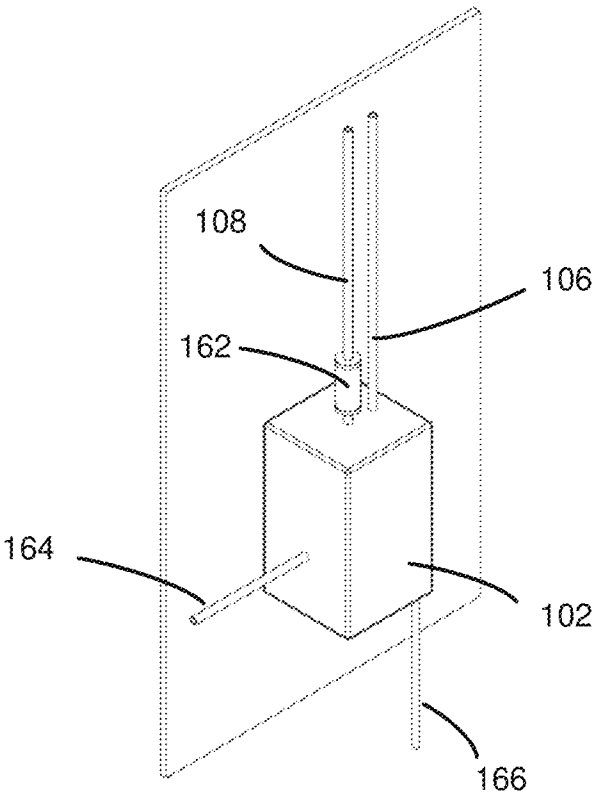
FIG. 5 is a perspective view of a central control unit of the centralized steam cleaning system of FIG. 1, according to one example.

FIG. 5 depicts an example central control unit 102 and its external connections. The central control unit 102 can be attached to a floor or other structure of the building. As shown, both the water pipeline 106 and the vacuum pipeline 108 are connected to the central control unit 102. In some examples, a debris filter 162 can be mounted on the vacuum pipeline 108. The debris filter 162, which can be replaced, can be configured to filter out debris in the vacuum pipeline 108.

In some examples, an exhaust pipe 164 can be connected to the central control unit 102. The exhaust pipe 164 can allow exhaust gas generated by the central steam cleaning system 100 to escape therethrough.

In some examples, the central control unit 102 can also be connected to a sewage pipe 166, which is configured to discharge dirty water or solution to a sewage system of the building.

In some examples, a water source, e.g., a water tank can be enclosed within the central control unit 102. In some examples, the water source can be external to the central control unit 102, such as the water reserve 116 depicted in FIG. 1.

Figure 6:
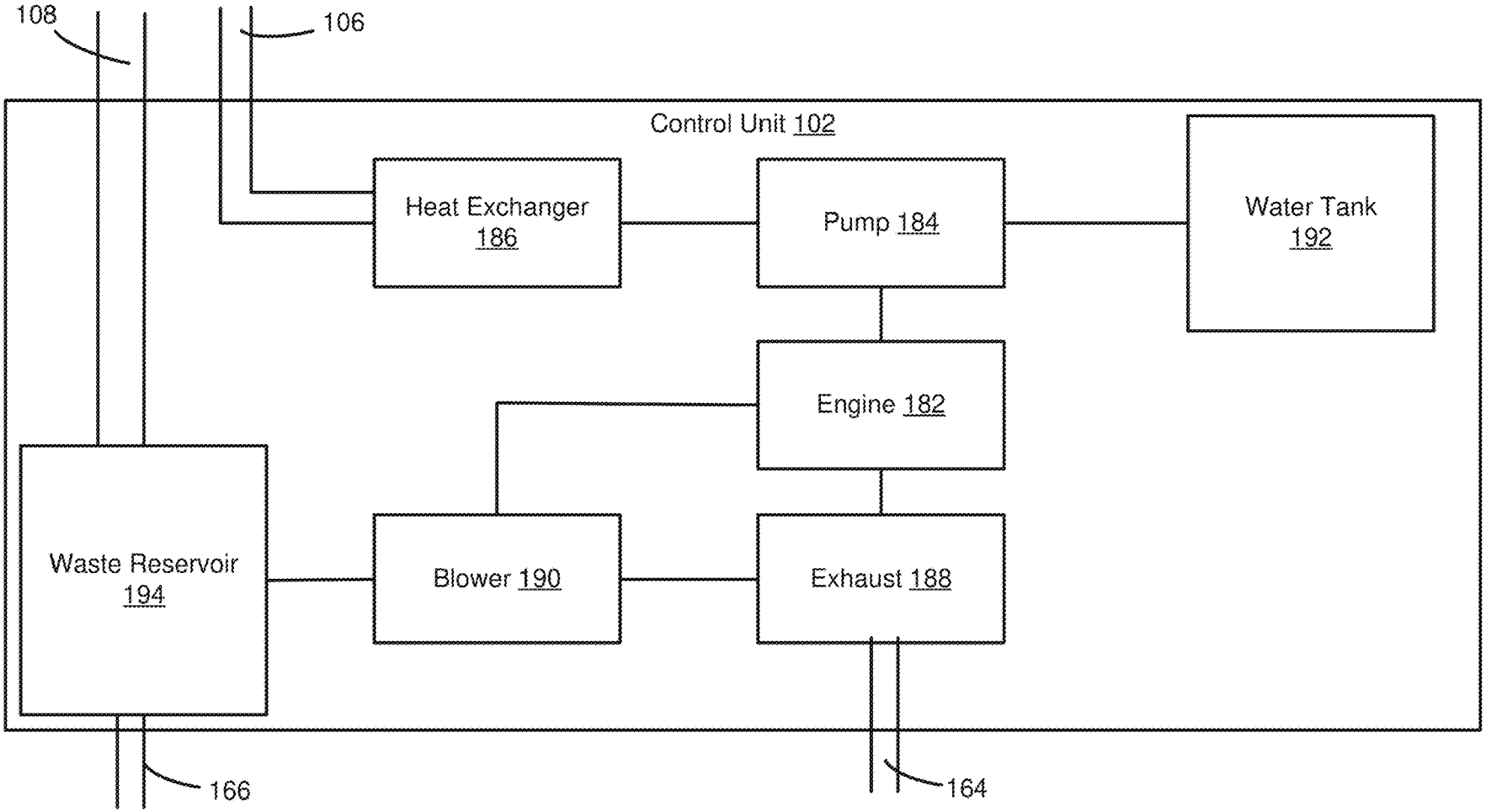
FIG. 6 is a block diagram of the central control unit of FIG. 5, according to one example.

FIG. 6 depicts a block diagram of the central control unit 102, according to one example. In the depicted example, the central control unit 102 can include an engine or motor 182, a water pump 184, a heat exchanger 186, an exhaust chamber 188, a blower 190, a water tank 192, and a waste reservoir 194.

The engine 182 can generate electricity to power the water pump 184, which receives clean water from the water tank 192. The pumped water can pass through the heat exchanger 186 where the water is heated (e.g., up to a boiling temperature) so as to generate a flow of water steam into the water pipeline 106. In some examples, certain detergent(s), sanitizer(s), disinfectant(s) and/or other cleaning solutions can be added to the water tank so that the generated water steam can comprise molecules of those additives.

The engine 182 can also power the blower 190 which can blow air into the exhaust chamber and further out of the control unit 102 through the exhaust pipe 164. By blowing the air, a negative pressure or vacuum can be created in the waste reservoir 194 and the vacuum pipeline 108 connected thereto. The negative pressure can suck the air, dirt, and water collected in the vacuum pipeline 108 into the waste reservoir 194. The waste (e.g., the dirt or dirty water) deposited in the waste reservoir 194 can be discharged into a sewage system of the building through the sewage pipe 166.

Example Accessories

Some accessories can be configured to work in conjunction with the central steam cleaning system 100 described above. In some circumstances, any of the accessories described herein can also be considered part of the central steam cleaning system 100.

Figure 7C:
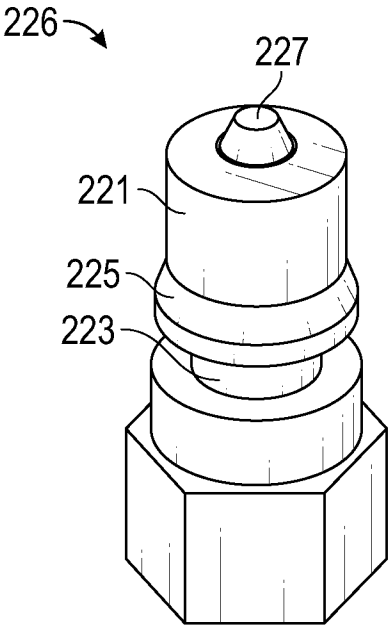
FIG. 7C depicts an example end of a water hose included in the hose assembly of FIG. 7A.
Figure 7B:
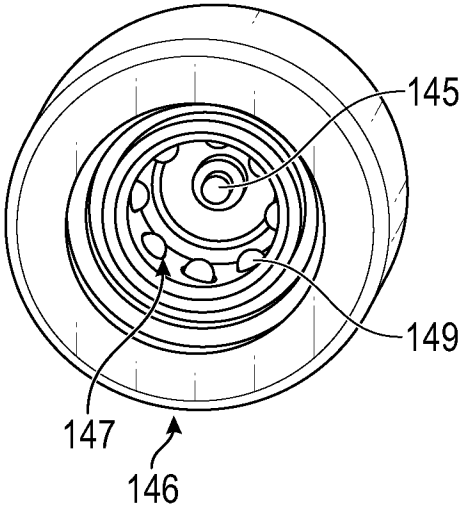
FIG. 7B depicts an example water adaptor included in the floor port of FIG. 3 and/or room port of FIG. 4A.
Figure 7A:
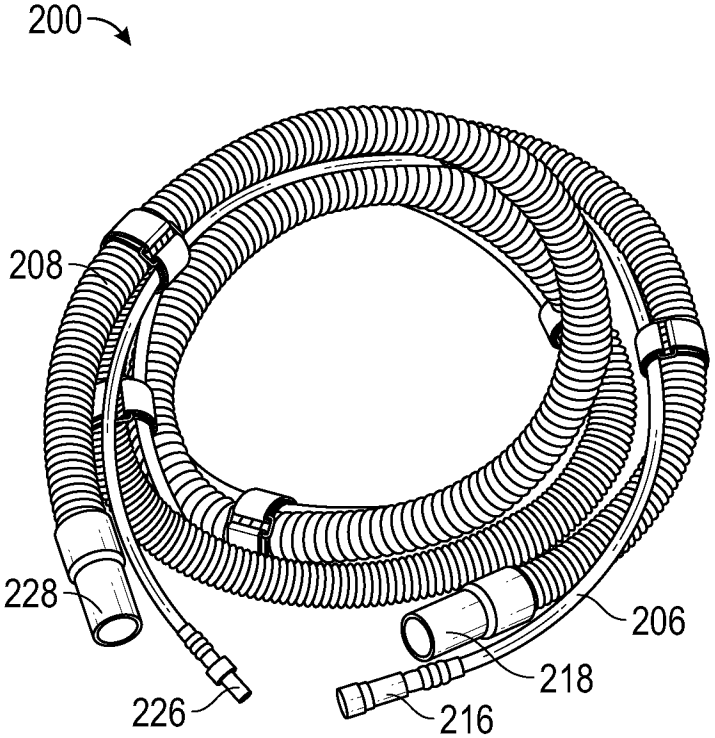
FIG. 7A depicts a hose assembly that can be used in conjunction with the centralized steam cleaning system of FIG. 1, according to one example.

FIGS. 7A depicts a hose assembly 200 that can be used in conjunction with (or be part of) the central steam cleaning system 100, according to one example. The hose assembly 200 can include a water hose 206 and a vacuum hose 208. The water hose 206 and the vacuum hose 208 can have about the same length and extend alongside each other. In some examples, the water hose 206 and the vacuum hose 208 can be bundled together. The length of the water hose 206 and the vacuum hose 208 can be customized (e.g., 10 feet, 20 feet, 50 feet, 100 feet, etc.) for different uses. In some examples, the water hose 206 and/or the vacuum hose 208 can comprise heavy duty kink free materials.

The vacuum hose 208 includes a first end 218 and a second end 228 opposite to the first end 218. The second end 228 can be releasably connected to the air adaptor 128 of the floor port 120 or the air adaptor 148 of the room port 140 described above (e.g., after removing the cap 134 or 154). The first end 218 is configured to be releasably connected to a portable cleaning device (e.g., 300) described further below.

In certain examples, the second end 228 can have internal threads that are configured to threadably mate with external threads of the air adaptor 128 or 148. In such case, the air adaptor 128 or 148 (acting as a male component) can be inserted into a lumen of the second end 228 (acting as a female component). In other examples, the second end 228 can be configured as the male component and the air adaptor 128 or 148 can be configured as the female component. Other coupling mechanisms (e.g., snap fit, interlocking grooves, inference fit, etc.) can be used to connect the second end 228 to the air adaptor 128 or 148.

The water hose 206 includes a first end 216 and a second end 226 opposite to the first end 216. The second end 226 can be releasably connected to the water adaptor 126 of the floor port 120 or the water adaptor 146 of the room port 140 described above. The first end 216 is configured to be releasably connected to a portable cleaning device (e.g., 300) described further below.

FIG. 7B shows an example internal structure of a water adaptor 146 (and the water adaptor 126 can have similar structure) and FIG. 7C shows an example second end 226 of the water hose 206. It is to be understood that the water adaptor 146 and the second end 226 can have other complimentary structures to allow them to be securely and releasably coupled together.

As shown in FIGS. 7B-7C, the second end 226 has a head portion 221 configured to be inserted into a lumen 147 of the water adaptor 146. The second end 226 has a distal tip 227 extending from a distal end of the head portion 221, a flange 225 projecting radially outwardly from the head portion 221, and a neck portion 223 having a smaller diameter than the flange 225. The neck portion 223 and the distal tip 227 are located on opposite sides of the flange 225. The water adaptor 146 can include a plurality of ball bearings 149 distributed around an inner wall defining the lumen 147. When inserting the head portion 221 into the lumen 147, the flange 225 can push the ball bearings 149 radially outwardly. After pushing the head portion 221 into the lumen 147, the ball bearings 149 can pop radially inwardly (e.g., through a biased spring mechanism) and received within the neck portion 223, thereby securely locking the second end 226 with the water adaptor 146. To disconnect, the second end 226 can be pulled away from the water adaptor 146 using a sufficiently large force that overcomes the resistance of the ball bearings 149 against the flange 225.

The base of the water adaptor 146 can have a nipple 145 which is connected to the inner seal (similar to 125) of the water adaptor 146. The nipple 145 can be coupled to a biasing mechanism (e.g., a spring) and movable between a resting state and a biased state. At the resting state, the biasing mechanism can push the nipple 145 toward the opening of the lumen 147, at which position the inner seal is configured to prevent water or water steam in the water pipeline 106 from flowing out of the water adaptor 146 through the lumen 147. After connecting the second end 226 to the water adaptor 146, the distal tip 227 of the second end 226 can push the nipple 145 in a distal direction (i.e., away from the opening of the lumen 147) to the biased state. The displacement of the nipple 145 from its resting state to the biased state can cause the corresponding movement of the inner seal, thereby allowing the water or water steam in the water pipeline 106 to flow into the lumen 147 of the water adaptor 146.

Figure 8:
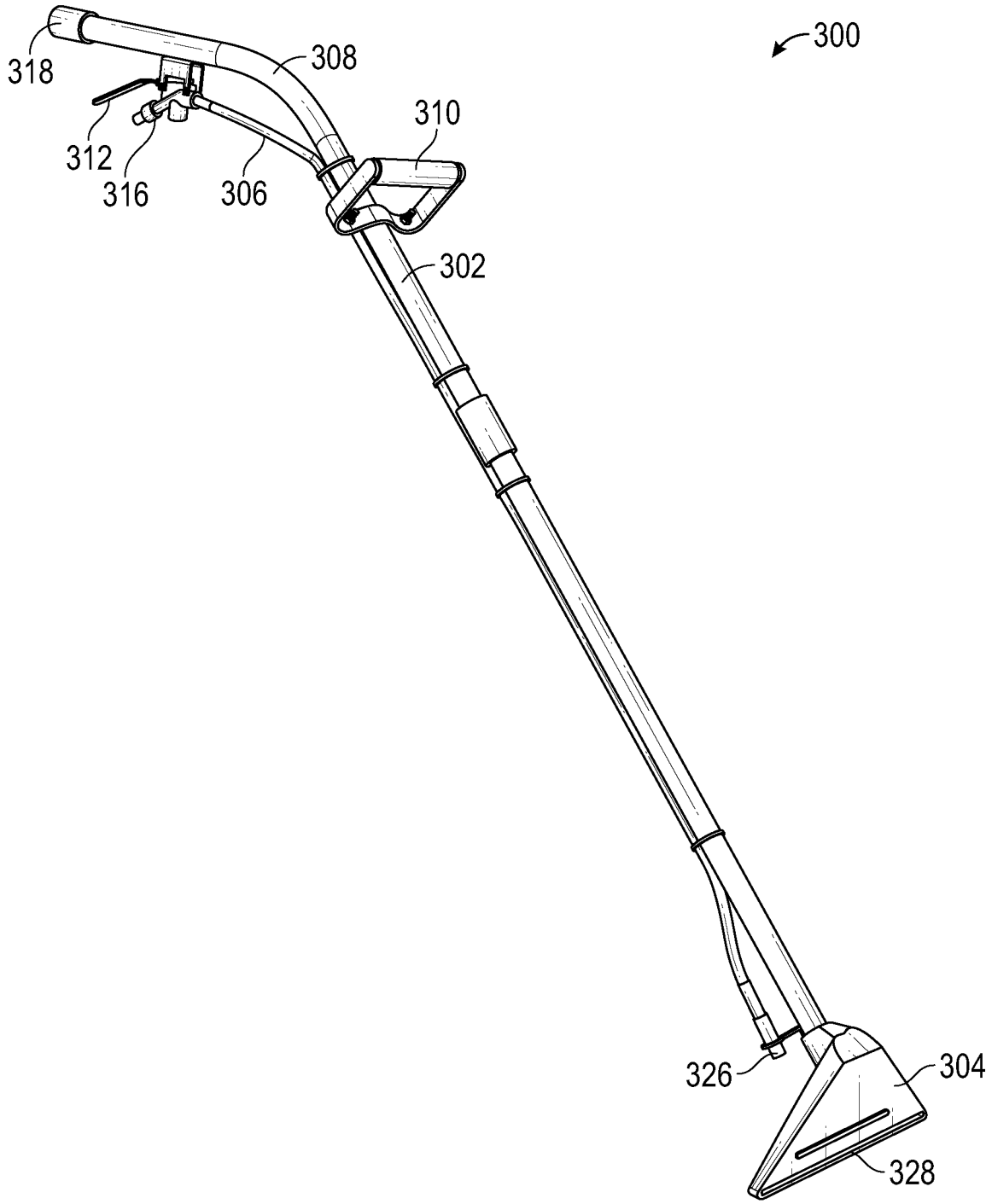
FIG. 8 depicts a portable cleaning device that can be used in conjunction with the centralized steam cleaning system of FIG. 1, according to one example.

FIG. 8 depicts an example portable cleaning device 300 that can be used in conjunction with (or be part of) the central steam cleaning system 100. The portable cleaning device 300 can include a wand 302 and a cleaning head 304 connected to a distal end of the wand 302. The wand 302 can have a handle 310 which the operator can grip. The handle 310 can be connected to a proximal end of the wand 302.

Although the wand 302 is depicted with a particular shape, it is to be understood that the wand 302 can have other shapes and/or dimensions in order to reach different areas (e.g., ceiling, stairs, countertops, etc.) for cleaning. In some examples, the wand 302 can be extendable.

The portable cleaning device 300 can include a water channel 306 and a vacuum channel 308. In some examples, the vacuum channel 308 can extend through a lumen of the wand 302 and into the cleaning head 304. In some examples, the water channel 306 can extend along (and side-by-side with) the wand 302.

The vacuum channel 308 can have a distal opening 328 located at the end of the cleaning head 304 and a proximal port 318. The proximal port 318 can be configured to be releasably connected to the first end 218 of the vacuum hose 208. Various coupling mechanisms (e.g., threads, clips, etc.) can be employed to couple the proximal port 318 to the first end 218.

The water channel 306 can have a distal opening 326 (e.g., a nozzle) and a proximal port 316. Water steam can be ejected or sprayed out of the distal opening 326. The proximal port 316 can be configured to be releasably connected to the first end 216 of the water hose 206. Various coupling mechanisms (e.g., threads, clips, etc.) can be employed to couple the proximal port 316 to the first end 216. In some examples, the portable cleaning device 300 can further include a control valve 312 connected to the water channel 306. The control valve 312 can be manually controlled by the operator to enable or disable water steam flow within the water channel 306, thereby controlling release of the water steam from the distal opening 326. For example, the control valve 312 can be a lever, which can be pulled in (toward the wand 302) to release the water steam.

Although in the above discussions, the portable cleaning device 300 is a separate entity from the hose assembly 200, in other examples, the hose assembly 200 can be an integral part of the portable cleaning device 300 (for example, the portable cleaning device 300 can have a built-in water hose and a built-in vacuum hose).

In some examples, the portable cleaning device 300 can be configured as a small hand-held attachment (e.g., without the wand 302) to the hose assembly 200. For example, the hand-held attachment can have a steam port (similar to the distal opening 326 of the water channel 306), which can be directly (and releasably) connected to the first end 216 of the water hose 206. The hand-held attachment can also have a vacuum port (similar to the distal opening 328 of the vacuum channel 308), which can be directly (and releasably) connected to the first end 218 of the vacuum hose 208. The hand-held attachment can further have a control valve (similar to the control valve 312) configured to enable or disable water steam to flow from the water hose 206 through and out of the steam port.

In some examples, the portable cleaning device 300 can be optional. For example, the first end 218 of the vacuum hose 208 can be used as a vacuum head to directly to vacuum a spot to be cleaned, and the first end 216 of the water hose 206 can be configured to spray or eject water steam onto the spot to be cleaned. A control valve (similar to the control valve 312) can be mounted adjacent the first end 216 of the water hose 206 to enable or disable releasing of the water steam from the water hose 206.

Example Steam Cleaning Methods

Example methods of steam cleaning of a building using the above central steam cleaning system 100 are described herein.

In some examples, the central control unit 102 can be actuated, e.g., by turning on the engine 182 to power the pump 184 and the blower 190 so as to generate a sufficiently high negative pressure or vacuum within the vacuum pipeline 108 and a hot water steam with a sufficiently high temperature within the water pipeline 106.

In certain examples, air valves 132 and water valves 130 in the floor ports 120 located in certain floors of the building can be shut off so as to increase the negative pressure and water pressure in other floors.

In certain examples, the hose assembly 200 can be connected to one of the floor ports (e.g., for cleaning the hallways) and/or the room ports (e.g., for cleaning individual rooms). Specifically, the second end 228 of the vacuum hose 208 can be connected to the air adaptor 128 or 148, and the second end 226 of the water hose 206 can be connected to the water adaptor 126 or 146. As a result, negative pressure can be generated within the vacuum hose 208 and the hot water steam can flow into the water hose 206.

In some examples, the portable cleaning device 300 can be connected to the hose assembly 200. Specifically, the proximal port 316 of the water channel 306 can be connected to the first end 216 of the water hose 206, and the proximal port 318 of the vacuum channel 308 can be connected to the first end 218 of the vacuum hose 208. As a result, the negative pressure can be generated within the vacuum channel 308 and the hot water steam can flow into the water channel 306.

Then, the operator can move the portable cleaning device 300 (coupled to the hose assembly 200 with a sufficient length) around the hallways or rooms for cleaning. Specifically, the operator can release or spray the hot water steam from the distal opening 326 of the water channel 306 (e.g., by controlling the control valve 304). The released hot water steam can loosen dirt or debris on target areas. The negative pressure in the vacuum channel 308 can simultaneously suck up the loosened-up dirt or debris, which can pass through the vacuum hose 208 and the vacuum pipeline 108 before being deposited into the waste reservoir.

The technologies from any example can be combined with the technologies described in any one or more of the other examples. In view of the many possible examples to which the principles of the disclosed technology can be applied, it should be recognized that the illustrated embodiments are examples of the disclosed technology and should not be taken as a limitation on the scope of the disclosed technology. Rather, the scope of the claimed subject matter is defined by the following claims and their equivalents.

We claim:

1. A centralized steam cleaning system comprising:

a central control unit;

a pipe network connected to the central control unit; and a plurality of ports connected to the pipe network, wherein the pipe network is configured to be distributed within a building, wherein the pipe network comprises a vacuum pipeline and a water pipeline that extend alongside each other, wherein the central control unit is configured to generate a negative pressure for air within the vacuum pipeline and a water steam within the water pipeline, wherein each port comprises an outlet of the water pipeline and an outlet of the vacuum pipeline, wherein the plurality of ports comprises one or more floor ports configured to be located at corresponding floors of the building, wherein each floor port comprises a floor port housing enclosing the outlet of the water pipeline and the outlet of the vacuum pipeline, wherein the water pipeline and the vacuum pipeline extend from a first side of the floor port housing to a second side of the floor port housing.

2. The centralized steam cleaning system of claim 1, wherein the negative pressure is between 6 psi and 9 psi, wherein the water steam has a temperature ranging between 200- and 240-degree Fahrenheit.

3. The centralized steam cleaning system of claim 1, wherein each floor port comprises an air valve and a water valve enclosed within the floor port housing.

4. The centralized steam cleaning system of claim 1, wherein the plurality of ports comprises one or more room ports configured to be located within corresponding rooms of the building, wherein each room port comprises a room port housing enclosing the outlet of the water pipeline and the outlet of the vacuum pipeline, wherein the water pipeline and the vacuum pipeline extend into the room port housing and do not exit from the room port housing.

5. The centralized steam cleaning system of claim 4, wherein each room port comprises a water valve enclosed within the room port housing, wherein the water valve is configured to enable or disable the water steam within the water pipeline to flow through the outlet of the water pipeline.

6. The centralized steam cleaning system of claim 1, further comprising a hose assembly, wherein the hose assembly comprises a water hose and a vacuum hose, wherein the water hose is configured to be releasably connected to the outlet of the water pipeline, wherein the vacuum hose is configured to be releasably connected to the outlet of the vacuum pipeline.

7. The centralized steam cleaning system of claim 6, wherein the outlet of the water pipeline comprises a seal configured to block the water steam within the water pipeline from escaping through the outlet of the water pipeline, wherein connecting the water hose to the outlet of the water pipeline is configured to displace the seal so as to enable the water steam within the water pipeline to escape through the outlet of the water pipeline.

8. The centralized steam cleaning system of claim 6, further comprising at least one portable cleaning device, wherein the at least one portable cleaning device comprises a water channel and a vacuum channel, wherein the water channel is configured to be releasably connected to the water hose, wherein the vacuum channel is configured to be releasably connected to the vacuum hose.

9. A centralized steam cleaning system comprising:

a pipe network configured to be distributed within a building, wherein the pipe network comprises a vacuum pipeline and a water pipeline that extend alongside each other; and a plurality of ports connected to the pipe network, wherein each port comprises an outlet of the water pipeline and an outlet of the vacuum pipeline, wherein the water pipeline is configured to allow a water steam to flow therethrough, wherein the vacuum pipeline is configured to allow an air under negative pressure to flow therethrough, wherein the plurality of ports comprises one or more floor ports, wherein each floor port comprises a floor port casing enclosing the outlet of the water pipeline and the outlet of the vacuum pipeline, wherein the water pipeline and the vacuum pipeline extend through the floor port casing.

10. The centralized steam cleaning system of claim 9, further comprising a central control unit configured to generate the negative pressure for the air within the vacuum pipeline and the water steam within the water pipeline.

11. The centralized steam cleaning system of claim 9, further comprising a hose assembly, wherein the hose assembly comprises a water hose and a vacuum hose that are bundled together, wherein the water hose is configured to be releasably connected to the outlet of the water pipeline, wherein the vacuum hose is configured to be releasably connected to the outlet of the vacuum pipeline.

12. The centralized steam cleaning system of claim 11, further comprising at least one portable cleaning device, wherein the at least one portable cleaning device comprises a wand, a cleaning head connected to a distal end of the wand, a water channel, and a vacuum channel, wherein the water channel and the vacuum channel extend through a lumen of the wand and into the cleaning head, wherein the water channel is configured to be releasably connected to the water hose, wherein the vacuum channel is configured to be releasably connected to the vacuum hose.

13. The centralized steam cleaning system of claim 9, wherein the plurality of ports comprises one or more room ports, wherein each room port comprises a room port casing enclosing the outlet of the water pipeline and the outlet of the vacuum pipeline, wherein the water pipeline and the vacuum pipeline extend into the room port casing and do not exit from the room port casing.

14. A centralized steam cleaning system comprising:

a pipe network configured to be distributed within a building, wherein the pipe network comprises a vacuum pipeline and a water pipeline that extend alongside each other; and a plurality of ports connected to the pipe network, wherein each port comprises an outlet of the water pipeline and an outlet of the vacuum pipeline, wherein the water pipeline is configured to allow a water steam to flow therethrough, wherein the vacuum pipeline is configured to allow an air under negative pressure to flow therethrough, wherein the plurality of ports comprises one or more room ports, wherein each room port comprises a room port casing enclosing the outlet of the water pipeline and the outlet of the vacuum pipeline, wherein the water pipeline and the vacuum pipeline extend into the room port casing and do not exit from the room port casing.

15. The centralized steam cleaning system of claim 14, further comprising a central control unit configured to generate the negative pressure for the air within the vacuum pipeline and the water steam within the water pipeline.

16. The centralized steam cleaning system of claim 14, further comprising a hose assembly, wherein the hose assembly comprises a water hose and a vacuum hose that are bundled together, wherein the water hose is configured to be releasably connected to the outlet of the water pipeline, wherein the vacuum hose is configured to be releasably connected to the outlet of the vacuum pipeline.

17. The centralized steam cleaning system of claim 16, further comprising a portable cleaning device, wherein the portable cleaning device comprises a wand, a cleaning head connected to a distal end of the wand, a water channel, and a vacuum channel, wherein the water channel is configured to be releasably connected to the water hose, wherein the vacuum channel is configured to be releasably connected to the vacuum hose.

18. The centralized steam cleaning system of claim 14, wherein each room port comprises a water valve enclosed within the room port casing, wherein the water valve is configured to enable or disable the water steam within the water pipeline to flow through the outlet of the water pipeline.

19. The centralized steam cleaning system of claim 14, wherein the plurality of ports further comprises one or more floor ports, wherein each floor port comprises a floor port casing enclosing the outlet of the water pipeline and the outlet of the vacuum pipeline, wherein the water pipeline and the vacuum pipeline extend through the floor port casing.

20. The centralized steam cleaning system of claim 19, wherein each floor port comprises an air valve and a water valve enclosed within the floor port casing.

* * * * *